US010287522B2

(12) United States Patent
Bi et al.

(10) Patent No.: US 10,287,522 B2
(45) Date of Patent: May 14, 2019

(54) SYSTEM AND METHOD FOR PREPARING COAL WATER SLURRY

(71) Applicant: General Electric Company, Schenectady, NY (US)

(72) Inventors: Xijing Bi, Shanghai (CN); Junli Xue, Shanghai (CN); Dejia Wang, Shanghai (CN); Raul Eduardo Ayala, Sugar Land, TX (US)

(73) Assignee: General Electric Company, Schenectady, NY (US)

( * ) Notice: Subject to any disclaimer, the term of this patent is extended or adjusted under 35 U.S.C. 154(b) by 803 days.

(21) Appl. No.: 14/169,585

(22) Filed: Jan. 31, 2014

(65) Prior Publication Data

US 2014/0208637 A1 Jul. 31, 2014

(30) Foreign Application Priority Data

Jan. 31, 2013 (CN) ..... 2013 1 0038770

(51) Int. Cl.
*C10L 1/32* (2006.01)
*C10L 5/00* (2006.01)

(52) U.S. Cl.
CPC ..... *C10L 1/326* (2013.01); *C10L 5/00* (2013.01)

(58) Field of Classification Search
CPC .... C10L 1/326; C10L 5/02; C10L 5/04; C10L 5/06
USPC ..... 44/280.639
See application file for complete search history.

(56) References Cited

U.S. PATENT DOCUMENTS 3,168,350 A 2/1965 Phinney et al.
3,762,887 A 10/1973 Clancey et al.
4,257,879 A * 3/1981 Bogenschneider ..... B03B 9/005 209/1
4,282,006 A 8/1981 Funk
4,290,897 A * 9/1981 Swihart ..... C02F 1/545 209/5

(Continued)

FOREIGN PATENT DOCUMENTS

CA 2012197 A1 9/1990
CN 85106713 B 11/1986

(Continued)

OTHER PUBLICATIONS

English Translation of CN 102041118 A.*

(Continued)

*Primary Examiner* — Latosha Hines
(74) *Attorney, Agent, or Firm* — Catherine J. Winter; GPO Global Patent Operation

(57) ABSTRACT

A system for preparing a coal water slurry, comprising: a first unit for providing a stream of coarse coal water slurry; a second unit for providing a stream of fine coal water slurry; a concentration unit for receiving a portion of at least one of the stream of coarse coal water slurry and the stream of fine coal water slurry, and, providing a concentrated stream having a higher coal concentration than the portion of at least one of the stream of coarse coal water slurry and the stream of fine coal water slurry; and a mixing unit for mixing the concentrated stream and the remaining portions of the stream of coarse coal water slurry and the stream of fine coal water slurry. An associated method is also presented.

21 Claims, 5 Drawing Sheets

(56) References Cited

U.S. PATENT DOCUMENTS

| | | | |
|---|---|---|---|
| 4,406,663 | A | 9/1983 | Baldwin et al. |
| 4,479,806 | A | 10/1984 | Funk |
| 4,500,041 | A | 2/1985 | Nakaoji et al. |
| 4,549,881 | A | 10/1985 | Mathiesen et al. |
| 4,592,759 | A | 6/1986 | Naka et al. |
| 4,620,672 | A | 11/1986 | Leibson et al. |
| 4,706,891 | A | 11/1987 | Nakaoji et al. |
| 4,712,742 | A | 12/1987 | Ogawa et al. |
| 4,770,352 | A | 9/1988 | Takamoto et al. |
| 4,904,277 | A | 2/1990 | Najjar et al. |
| 4,950,307 | A | 8/1990 | Najjar et al. |
| 5,290,324 | A | 3/1994 | Yokokawa et al. |
| 5,599,356 | A | 2/1997 | Hashimoto et al. |
| 6,053,954 | A | 4/2000 | Anderson et al. |
| 6,132,478 | A | 10/2000 | Tsurui et al. |
| 6,664,302 | B2 | 12/2003 | French et al. |
| 8,118,890 | B2 | 2/2012 | Schingnitz et al. |
| 2008/0134578 | A1 | 6/2008 | Yu et al. |
| 2010/0024282 | A1 | 2/2010 | Joseph et al. |
| 2012/0255221 | A1* | 10/2012 | Wang ..... C10L 1/326 44/280 |

FOREIGN PATENT DOCUMENTS

| | | | |
|---|---|---|---|
| CN | 1986106456 | A | 7/1987 |
| CN | 1042373 | A | 5/1990 |
| CN | 1046179 | A | 10/1990 |
| CN | 2066347 | U | 11/1990 |
| CN | 2079257 | U | 6/1991 |
| CN | 2093356 | U | 1/1992 |
| CN | 2103123 | U | 4/1992 |
| CN | 2105990 | U | 6/1992 |
| CN | 1063503 | A | 8/1992 |
| CN | 2114159 | U | 8/1992 |
| CN | 1069759 | A | 3/1993 |
| CN | 1030576 | C | 12/1995 |
| CN | 1125163 | A | 6/1996 |
| CN | 1034761 | C | 4/1997 |
| CN | 1186840 | A | 7/1998 |
| CN | 2306406 | Y | 2/1999 |
| CN | 1262309 | A | 8/2000 |
| CN | 1275611 | A | 12/2000 |
| CN | 1072681 | C | 10/2001 |
| CN | 2460865 | Y | 11/2001 |
| CN | 2475475 | Y | 2/2002 |
| CN | 1355399 | A | 6/2002 |
| CN | 1092230 | C | 10/2002 |
| CN | 1389547 | A | 1/2003 |
| CN | 1404912 | A | 3/2003 |
| CN | 1125093 | C | 10/2003 |
| CN | 1538110 | A | 10/2004 |
| CN | 1775920 | A | 5/2006 |
| CN | 2779125 | Y | 5/2006 |
| CN | 2783005 | Y | 5/2006 |
| CN | 1786563 | A | 6/2006 |
| CN | 2797702 | Y | 7/2006 |
| CN | 2800082 | Y | 7/2006 |
| CN | 1818041 | A | 8/2006 |
| CN | 2804447 | Y | 8/2006 |
| CN | 1865399 | A | 11/2006 |
| CN | 2852109 | Y | 12/2006 |
| CN | 2856727 | Y | 1/2007 |
| CN | 1908134 | A | 2/2007 |
| CN | 1945259 | A | 4/2007 |
| CN | 2908510 | Y | 6/2007 |
| CN | 2931865 | Y | 8/2007 |
| CN | 2931877 | Y | 8/2007 |
| CN | 101050863 | A | 10/2007 |
| CN | 200989323 | Y | 12/2007 |
| CN | 100372916 | C | 3/2008 |
| CN | 201043513 | Y | 4/2008 |
| CN | 101173765 | A | 5/2008 |
| CN | 101177640 | A | 5/2008 |
| CN | 101195773 | A | 6/2008 |
| CN | 101220286 | A | 7/2008 |
| CN | 101220287 | A | 7/2008 |
| CN | 101225335 | A | 7/2008 |
| CN | 101250455 | A | 8/2008 |
| CN | 201106565 | Y | 8/2008 |
| CN | 201106575 | Y | 8/2008 |
| CN | 201110280 | Y | 9/2008 |
| CN | 100562558 | C | 11/2009 |
| CN | 101760267 | A | 6/2010 |
| CN | 101054541 | B | 11/2010 |
| CN | 201729818 | U | 2/2011 |
| CN | 101995029 | A | 3/2011 |
| CN | 101003358 | B | 5/2011 |
| CN | 102041118 | A * | 5/2011 |
| CN | 102229825 | A | 11/2011 |
| CN | 102260556 | A | 11/2011 |
| CN | 102443450 | A | 5/2012 |
| CN | 101191492 | B | 9/2012 |
| CN | 102192520 | B | 7/2013 |
| EP | 0223755 | A2 | 5/1987 |
| EP | 0223573 | B1 | 8/1991 |
| EP | 0978553 | A1 | 2/2000 |
| JP | 6433190 | A | 2/1989 |
| JP | 7041778 | A | 2/1995 |
| JP | 7173476 | A | 7/1995 |

OTHER PUBLICATIONS

Atesok et al., "The Effects of Dispersants (PSS—NSF) used in Coal-Waterslurries on the Grindability of Coals of Different Structures", Fuel, vol. 84, Issue 7-8, pp. 801-808, May, 2005.

Weidong et al., "Particle Size Distribution Control of Coal-Water Slurry with Effective Medium Model", 2nd International Workshop on Database Technology and Applications (DBTA), pp. 1-4, Nov. 27-28, 2010.

Henderson et al., "CWS Rheology: The Role of the Coal Particle".

Marvin et al., "CWS Rheology: The Role of the Coal Particle".

Unofficial English Translation of Chinese Office Action issued in connection with corresponding CN Application No. 201310038770.0 dated Apr. 14, 2015.

"Rectification and Amplification Equipment Handout", Chengdu Institute of Radio Engineering Selections, pp. 5-7, 1962.

Tsai et al., "Viscometry and Rheology of Coal Water Slurry", Fuel, vol. No. 65, Issue No. 4, pp. 566-571, Apr. 1986.

Rawlins et al., "Low-Rank Coal-Water Fuel Combustion in a Laboratory-Scale Furnace", Combustion and Flame, vol. No. 74, Issue No. 3, pp. 255-266, Dec. 1988.

Logos et al., "Effect of Particle Size on the Flow Properties of a South Australian Coal-Water Slurry", Powder Technology, vol. No. 88, Issue No. 1, pp. 55-58, 1996.

Usuia et al., "Rheology of Low Rank Coal Slurries Prepared by an Upgrading Process", Coal Preparation, vol. No. 18, Issue No. 3-4, pp. 119-128, 1997.

Aktas et al., "Effect of Addition of Surface Active Agent on the Viscosity of a High Concentration Slurry of a Low-Rank British Coal in Water", Fuel Processing Technology, vol. No. 62, Issue No. 1, pp. 1-15, Jan. 2000.

Harmadi et al., "Effect of Particle Size Distribution on Rheology and Stability of High Concentration Coal-Water Mixture (Cwm) with Indonesian Low Rank Coal", Jurnal Teknik Mesin, vol. No. 2, Issue No. 3, pp. 93-98, Sep. 2002.

Jing et al., "Increase in Stability of Datong Coal Water Slurry Through Improving Particle Size Graduation", Journal of Beijing University of Chemical Technology, vol. No. 29, Issue No. 1, pp. 93-94 & 97, 2002.

Linshan et al., "Coal Water Slurry Preparation and Application Technology", Coal Industry Press, pp. 134-135, Sep. 30, 2003.

Zhao et al., "Increase Stability of Shenfu Coal Water Mixture Through Improving Particle Size Graduation", Coal Engineering, Issue No. 12, pp. 88-90, 2006.

Ye et al., "Effect of Blended Coal Particle Size Gradation on Concentration and Viscosity of Coal-Water Slurry", Coal conversion, vol. No. 31, Issue No. 02, pp. 28-30, 2008.

(56) References Cited

OTHER PUBLICATIONS

Xu et al., "The Theory and Practice of Chemical Processing of Coal", China Petrochemical Press, pp. 139-142, Nov. 30, 2009.
Chen et al., "Preparation and Rheology of Biochar, Lignite Char and Coal Slurry Fuels", Fuel, vol. No. 90, Issue No. 4, pp. 1689-1695, Apr. 2011.
Wen-Xin et al., "Study of High Concentration Ningdong Coal-Water-Slurry Through Improving Particles Size Grading", Chemical engineer, Issue No. 11, pp. 57-58 & 71, 2010.
IP.com, "Optimal Particle Size Distribution of Coal for Preparation of Increased Concentration Coal Water Slurry in Gasification", IP.com Electronic Publication, IPCOM000206287D, pp. 1-7, Apr. 18, 2011.
Li, "Progress of High Concentration Coal Water Slurry (CWS) Preparation Technology from Low Rank Coals and Lignite for CWS Gasification", Chinese Academy of Sciences, Sep. 12-15, 2011.
European Search Report and Opinion issued in connection with related EP Application No. 12163250.9 dated Jul. 5, 2012.
Unofficial English Translation of Chinese Office Action issued in connection with related CN Application No. 201110085720.9 dated Dec. 31, 2012.
Unofficial English Translation of Chinese Office Action issued in connection with related CN Application No. 201210109334.3 dated Aug. 5, 2014.
Unofficial English Translation of Chinese Office Action issued in connection with related CN Application No. 201210506847.8 dated Feb. 10, 2015.
Unofficial English Translation of Chinese Office Action issued in connection with related CN Application No. 201210109334.3 dated Feb. 17, 2015.
U.S. Non-Final Office Action issued in connection with related U.S. Appl. No. 14/089,825 dated Aug. 21, 2015.
Unofficial English Translation of Chinese Office Action issued in connection with related CN Application No. 201210506847.8 dated Mar. 7, 2016.
Unofficial English Translation of Chinese Office Action issued in connection with related CN Application No. 201210506847.8 dated Sep. 1, 2016.
Australian Office Action issued in connection with related AU Application No. 2013260745 dated Sep. 21, 2016.
Australian Notice of Allowance issued in connection with related AU Application No. 2013260745 dated Nov. 16, 2016.
Unofficial English Translation of Chinese Office Action issued in connection with related CN Application No. 201210506847.8 dated Jan. 17, 2017.

* cited by examiner

SYSTEM AND METHOD FOR PREPARING COAL WATER SLURRY

BACKGROUND

This invention relates generally to systems and methods for preparing coal water slurries.

Coal water slurries are widely used these days in such as gasification industries. Generally, higher coal concentration in a coal water slurry with an acceptable viscosity are more desirable. However, currently available systems and methods cannot provide satisfactory coal water slurries, especially from low rank coals.

Therefore, there is a need for new and improved systems and methods for preparing coal water slurries.

BRIEF DESCRIPTION

In one aspect, a system for preparing a coal water slurry is provided and comprises a first unit for providing a stream of coarse coal water slurry; a second unit for providing a stream of fine coal water slurry; a concentration unit for receiving a portion of at least one of the stream of coarse coal water slurry and the stream of fine coal water slurry, and, providing a concentrated stream having a higher coal concentration than the portion of at least one of the stream of coarse coal water slurry and the stream of fine coal water slurry; and a mixing unit for mixing the concentrated stream and remaining portions of the stream of coarse coal water slurry and the stream of fine coal water slurry.

In another aspect, a method for preparing a coal water slurry is provided and comprises: preparing a stream of coarse coal water slurry; preparing a stream of fine coal water slurry; concentrating a portion of at least one of the stream of coarse coal water slurry and the stream of fine coal water slurry, to provide a concentrated stream having a higher coal concentration than the portion of at least one of the stream of coarse coal water slurry and the stream of fine coal water slurry; and mixing the concentrated stream and the remaining portions of the stream of coarse coal water slurry and the stream of fine coal water slurry.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF THE DISCLOSURE

Figure 1:
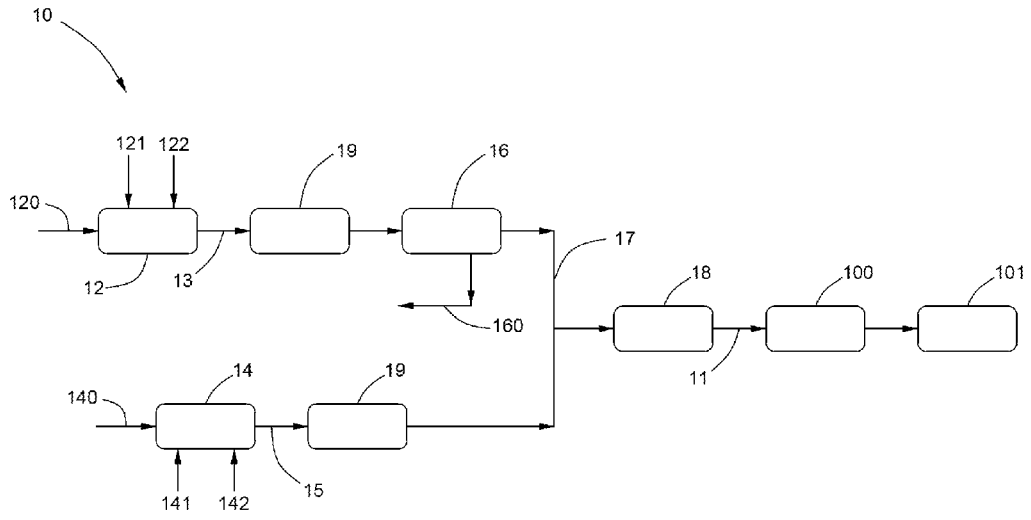
FIG. 1 is a schematic diagram of a system for preparing a coal water slurry in accordance with a first embodiment of the present invention.

Approximating language, as used herein throughout the specification and claims, may be applied to modify any quantitative representation that could permissibly vary, without resulting in a change in the basic function to which it is related. Accordingly, a value modified by a term or terms, such as "about", is not limited to the precise value specified. In some instances, the approximating language may correspond to the precision of an instrument for measuring the value.

In the following specification and claims, the singular forms "a", "an" and "the" include plural referents, unless the context clearly dictates otherwise. Moreover, the suffix "(s)" as used herein is usually intended to include both the singular and the plural of the term that it modifies, thereby including one or more of that term. The terms "first," "second," and the like, herein do not denote any order, quantity, or importance, but rather are used to distinguish one element from another or one embodiment from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable. For example, in some circumstances, an event or capacity can be expected, while in other circumstances, the event or capacity cannot occur. This distinction is captured by the terms "may" and "may be".

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 600 to 1000, it is intended that values such as 600 to 850, 651 to 902, 700 to 851, 800 to 1000 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Reference throughout the specification to "one embodiment," "another embodiment," "an embodiment," "some embodiments," and so forth, means that a particular element (e.g., feature, structure, and/or characteristic) described in connection with the invention is included in at least one embodiment described herein, and may or may not be present in other embodiments. In addition, it is to be understood that the described inventive features may be combined in any suitable manner in the various embodiments and configurations.

Preferred embodiments of the present disclosure will be described hereinbelow with reference to the accompanying drawings. In the following description, well-known functions or constructions are not described in detail to avoid obscuring the disclosure in unnecessary detail.

FIGS. 1-5 illustrate schematic diagrams of systems 10-50 in accordance with embodiments of the invention and for preparing coal water slurries 11-51. The system 10, 20, 30, 40, 50 comprises a first unit 12, 22, 32, 42, 52 for providing a stream of coarse coal water slurry 13, 23, 33, 43, 53; a second unit 14, 24, 34, 44, 54 for providing a stream of fine coal water slurry 15, 25, 35, 45, 55; a concentration unit 16, 26, 36, 46, 56 for receiving a portion of at least one of the stream of coarse coal water slurry 13, 23, 33, 43, 53 and the stream of fine coal water slurry 15, 25, 35, 45, 55, and, providing a concentrated stream 17, 27, 37, 47, 57 having a higher coal concentration than the portion of at least one of the stream of coarse coal water slurry 13, 23, 33, 43, 53 and the stream of fine coal water slurry 15, 25, 35, 45, 55; and a mixing unit 18, 28, 38, 48, 58 for mixing the concentrated stream 17, 27, 37, 47, 57 and remaining portions of the stream of coarse coal water slurry 13, 23, 33, 43, 53, and the stream of fine coal water slurry 15, 25, 35, 45, 55.

In the first unit 12, 22, 32, 42, 52, coal 120, 220, 320, 420, 520 and water 121, 221, 321, 421, 521 are provided to a wet mill, such as a wet rod mill, to prepare the stream of coarse coal water slurry 13, 23, 33, 43, 53. An additive 122, 222, 322, 422, 522 is optionally added to the first unit 12, 22, 32, 42, 52 for preparing the stream of coarse coal water slurry 13, 23, 33, 43, 53. In some embodiments, the stream of coarse coal water slurry 13, 23, 33, 43, 53 comprises coal particles having a maximum particle size of less than or equal to about 1500 μm and a mean particle size of greater than or equal to about 100 μm.

In the second unit 14, 24, 34, 44, 54, coal 140, 240, 340, 440, 540 and water 141, 241, 341, 441, 541 are provided to a wet fine mill to prepare the stream of fine coal water slurry 15, 25, 35, 45, 55. An additive 142, 242, 342, 442, 542 is optionally added to the second unit 14, 24, 34, 44, 54 for preparing the stream of fine coal water slurry 15, 25, 35, 45, 55. In non-limiting examples, the second unit 14, 24, 34, 44, 54 may comprise a fine mill including a vibrating mill or a roller grinding mill. In one example, the second unit 14, 24, 34, 44, 54 comprises a Loesche mill. In some embodiments, the stream of fine coal water slurry 15, 25, 35, 45, 55 comprises coal particles having a mean particle size of smaller than or equal to about 25 μm.

In some applications, one or more mills or crushers may be employed in each of the first unit 12, 22, 32, 42, 52, and the second unit 14, 24, 34, 44, 54. In some applications, in order to save energy for milling the coal particles, during milling, a portion of the coarse coal water slurry 13, 23, 33, 43, 53 are introduced into the second unit 14, 24, 34, 44, 54 for producing the at least a portion of the fine coal water slurry 15, 25, 35, 45, 55.

In some embodiments, the coal 120, 140, 220, 240, 320, 340, 420, 440, 520, 540 may comprise one or more of high rank coal, such as bituminous and anthracite, and low rank coal, such as sub-bituminous coal and lignite. In some examples, the coal 120, 140, 220, 240, 320, 340, 420, 440, 520, 540 may comprise a mixture of the low rank coal particles and the high rank coal particles. In one non-limiting example, the coal 120, 140, 220, 240, 320, 340, 420, 440, 520, 540 comprises low rank coal particles, such as the sub-bituminous coal and the lignite. Since the cost of low rank coal is lower, it may be cost-effective in some examples to produce the coal water slurry having higher coal concentration using the low rank coal. In other examples, the coal 120, 140, 220, 240, 320, 340, 420, 440, 520, 540 comprises high rank coal particles.

The particle sizes of the coal 120, 140, 220, 240, 320, 340, 420, 440, 520, 540 may be smaller than about 3 mm. Alternatively, the particle sizes of the coal 120, 140, 220, 240, 320, 340, 420, 440, 520, 540 may be different from each other and greater than about 3 mm. One or more coal supply sources (not shown) may be employed to provide each of the coal 120, 140, 220, 240, 320, 340, 420, 440, 520, 540.

In certain embodiments, one or more of the coals 120, 140, 220, 240, 320, 340, 420, 440, 520 and 540 may comprise one or more of the low rank coal and the high rank coal, and the coals 120, 140, 220, 240, 320, 340,420, 440, 520 and 540 may be the same or different from each other. In one non-limiting example, the coals 120, 140, 220, 240, 320, 340,420, 440, 520 and 540 comprise the same low rank coal. Alternatively, the coals 120, 140, 220, 240, 320, 340,420, 440, 520 and 540 comprise the same high rank coal.

The concentration unit 16, 26, 36, 46, 56 may comprise any device that separates the portion of at least one of the stream of coarse coal water slurry 13, 23, 33, 43, 53 and the stream of fine coal water slurry 15, 25, 35, 45, 55 into a discharge stream 160, 260, 360, 460, 560, mainly comprising water, and the concentrated stream 17, 27, 37, 47, 57, so that the concentrated stream 17, 27, 37, 47, 57 has a higher coal concentration than the portion of at least one of the stream of coarse coal water slurry 13, 23, 33, 43, 53 and the stream of fine coal water slurry 15, 25, 35, 45, 55.

In some embodiment, the concentration unit 16, 26, 36, 46, 56 comprises at least one of a filter, a centrifuge and an evaporator. In some embodiments, the concentration unit 16, 26, 36, 46, 56 comprises at least one of a vacuum filter and a pressure filter.

According to embodiments of the present invention, the portion of at least one of the stream of coarse coal water slurry 13, 23, 33, 43, 53 and the stream of fine coal water slurry 15, 25, 35, 45, 55 may be any portion in a range of from greater than 0% to equal to 100% of the total of the stream of coarse coal water slurry coarse coal water slurry 13, 23, 33, 43, 53 and the stream of fine coal water slurry 15, 25, 35, 45, 55. Correspondingly, the remaining portions of the stream of coarse coal water slurry 13, 23, 33, 43, 53 and the stream of fine coal water slurry 15, 25, 35, 45, 55 may be any portion in a range of from 0% to less than 100% of the total of the stream of coarse coal water slurry coarse coal water slurry 13, 23, 33, 43, 53 and the stream of fine coal water slurry 15, 25, 35, 45, 55.

Figure 3:
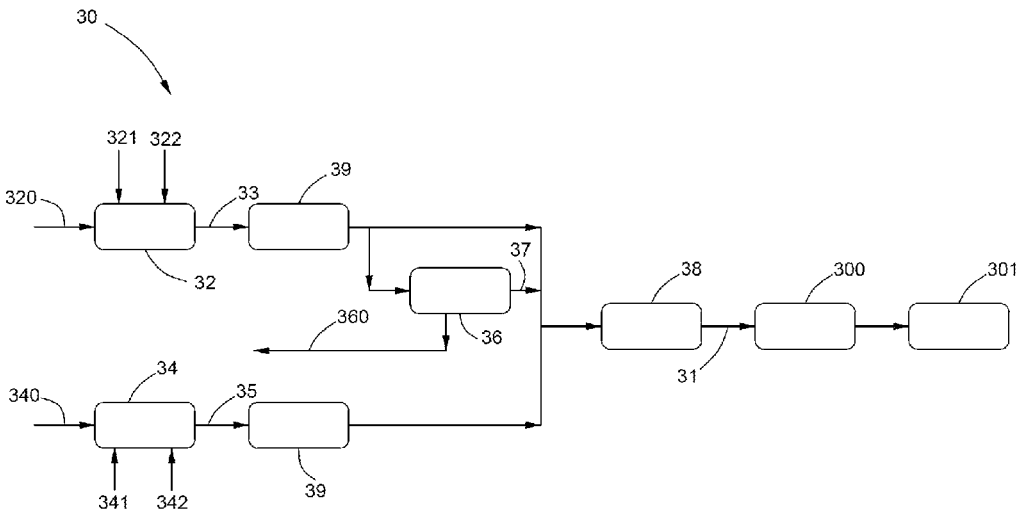
FIG. 3 is a schematic diagram of a system for preparing a coal water slurry in accordance with a third embodiment of the present invention.

In some embodiments, as illustrated in FIGS. 1 and 3, the portion of at least one of the stream of coarse coal water slurry coarse coal water slurry 13, 23, 33, 43, 53 and the stream of fine coal water slurry 15, 25, 35, 45, 55 is at least a portion of the stream of the coarse coal water slurry 13, 33, i.e., 100% of the stream of the coarse coal water slurry 13 and greater than 0% but less than 100% of the stream of the coarse coal water slurry 33. Correspondingly, the remaining portions of the stream of coarse coal water slurry coarse coal water slurry 13, 23, 33, 43, 53 and the stream of fine coal water slurry 15, 25, 35, 45, 55 are the stream of fine coal water slurry 15, 35 and the remaining portions of the coarse coal water slurry 13, 33, i.e., 0% of the stream of the coarse coal water slurry 13 and greater than 0% but less than 100% of the stream of the coarse coal water slurry 33.

Figure 2:
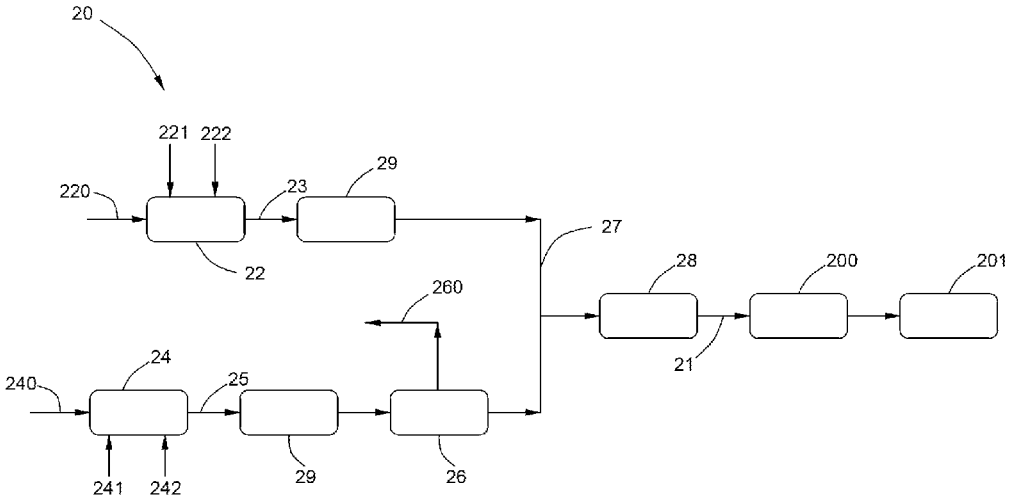
FIG. 2 is a schematic diagram of a system for preparing a coal water slurry in accordance with a second embodiment of the present invention.

In some embodiments, as illustrated in FIG. 2, the portion of at least one of the stream of coarse coal water slurry coarse coal water slurry 13, 23, 33, 43, 53 and the stream of fine coal water slurry 15, 25, 35, 45, 55 is 100% of the stream of the fine coal water slurry 25. Correspondingly, the remaining portions of the stream of coarse coal water slurry coarse coal water slurry 13, 23, 33, 43, 53 and the stream of fine coal water slurry 15, 25, 35, 45, 55 is the stream of coarse coal water slurry 23. Though not shown in figures, the portion of at least one of the stream of coarse coal water slurry coarse coal water slurry 13, 23, 33, 43, 53 and the stream of fine coal water slurry 15, 25, 35, 45, 55 may be greater than 0% but less than 100% of the stream of the fine coal water slurry 25 too.

Figure 4:
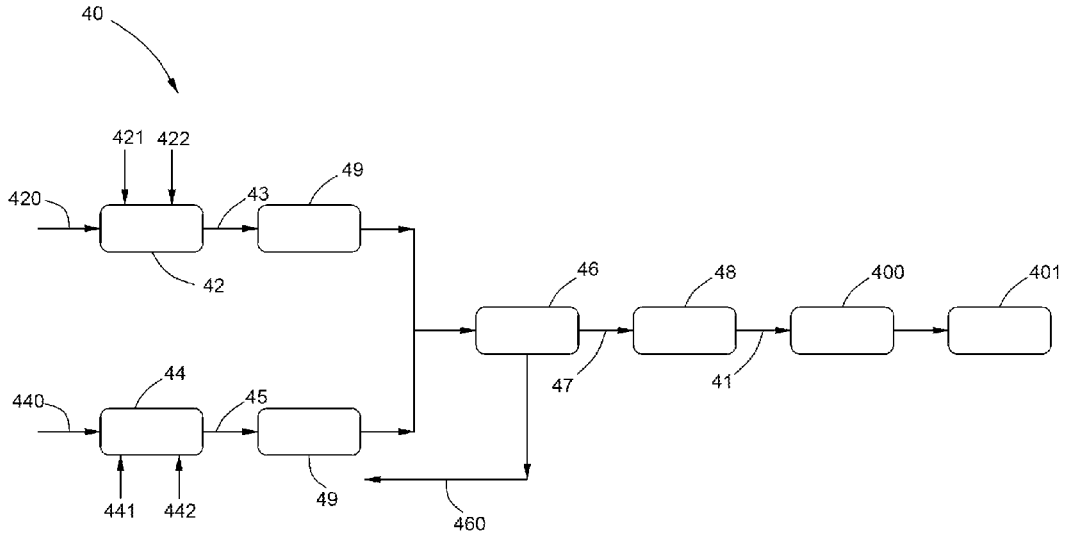
FIG. 4 is a schematic diagram of a system for preparing a coal water slurry in accordance with a fourth embodiment of the present invention.
Figure 5:
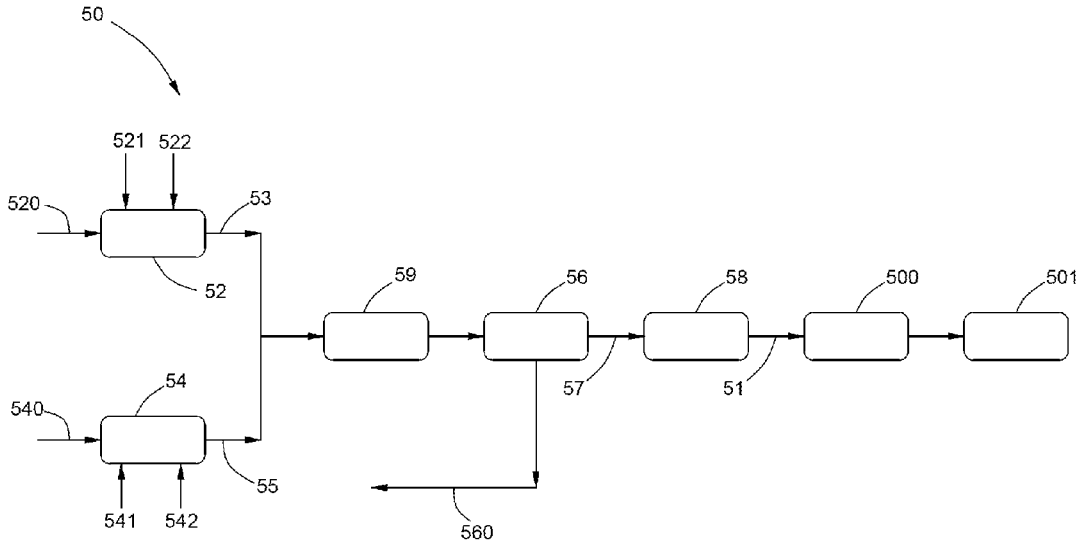
FIG. 5 is a schematic diagram of a system for preparing a coal water slurry in accordance with a fifth embodiment of the present invention.

In some embodiments, as illustrated in FIGS. 4 and 5, the portion of at least one of the stream of coarse coal water slurry 13, 23, 33, 43, 53 and the stream of fine coal water slurry 15, 25, 35, 45, 55 is a mixture of the stream of coarse coal water slurry 43, 53 and the stream of the fine coal water slurry 45, 55. Correspondingly, there are no remaining portions of the stream of coarse coal water slurry 13, 23, 33, 43, 53 and the stream of fine coal water slurry 15, 25, 35, 45, 55 and only the concentrated stream 47, 57 is mixed in the mixing unit 48, 58. Though not shown in figures, the portion of at least one of the stream of coarse coal water slurry 13, 23, 33, 43, 53 and the stream of fine coal water slurry 15, 25, 35, 45, 55 may also be a mixture of a portion (greater than 0% and less than 100%) of the stream of coarse coal water slurry 13, 23, 33, 43, 53 and a portion (greater than 0% and less than 100%) of the stream of the fine coal water slurry 15, 25, 35, 45, 55.

The discharge stream 160, 260, 360, 460, 560 mainly comprises water. In some embodiments, more than 50 w % of the discharge stream 160, 260, 360, 460, 560 is water. In some embodiments, the discharge stream 160, 260, 360, 460, 560 is discharged from the system 10, 20, 30, 40, 50 when no further use is needed. In some embodiments, the discharge stream 160, 260, 360, 460, 560, e.g., when the concentrating unit 16, 26, 36, 46, 56 is a filter, the filtrate, is recycled, such as to be used in at least one of the first unit 12, 22, 32, 42, 52 and the second unit 14, 24, 34, 44, 54.

In some embodiments, the system 10, 20, 30, 40, 50 optionally comprises a screening unit 19, 29, 39, 49, 59 before the concentration unit 16, 26, 36, 46, 56. The screening unit 19, 29, 39, 49, 59 may comprise any device that separates solid contents that are of undesirable sizes from other portions of coal water slurries. In some embodiments, the screening unit 19, 29, 39, 49, 59 comprises a trommel screen.

In some embodiments, as is shown in FIGS. 1-4, the screening unit 19, 29, 39, 49 is disposed after each of the first unit 12, 22, 32, 42 and the second unit 14, 24, 34, 44 to screen the coarse coal water slurry 13, 23, 33, 43 and the fine coal water slurry 15, 25, 35, 45, respectively. In some embodiments, as is illustrated in FIG. 5, the screening unit 59 is configured to receive a mixture of the coarse coal water slurry 53 and the fine coal water slurry 55.

The concentrated stream 17, 27, 37, 47, 57 and the remaining portions of the stream of coarse coal water slurry 13, 23, 33, 43, 53 and the stream of fine coal water slurry 15, 25, 35, 45, 55 are mixed in the mixing unit 18, 28, 38, 48, 58 at appropriate ratios to prepare the coal water slurry 11, 21, 31, 41, 51. As used herein, the term "mixing the concentrated stream and remaining portions of the stream of coarse coal water slurry and the stream of fine coal water slurry" refers to the scenario of mixing both the concentrated stream and the remaining portions of the stream of coarse coal water slurry and the stream of fine coal water slurry, and the scenario of mixing only the concentrated stream when there are no remaining portions. In some embodiments, as illustrated in FIGS. 4 and 5, when the remaining portions of the stream of coarse coal water slurry 43, 53 and the stream of fine coal water slurry 45, 55 are 0% of the total of the stream of coarse coal water slurry 43, 53 and the stream of fine coal water slurry 45, 55, only the concentrated stream 47, 57 is mixed in the mixing unit 48, 58.

In some embodiments, the coal from the stream of coarse coal water slurry 13, 23, 33, 43, 53 is greater than or equal to about 70 wt % (dry basis) of coal of the coal water slurry 11, 21, 31, 41, 51. As used herein, wt % means a weight percentage. In some embodiments, the coal from the stream of fine coal water slurry 25, 25, 35, 45 is less than or equal to about 30 wt % (dry basis) of coal of the coal water slurry 11, 21, 31, 41, 51.

In some embodiments, prior to introduction into the mixing unit 18, 28, 38, 48, 58, the particle size distribution of the concentrated stream 17, 27, 37, 47, 57 and the remaining portions of the stream of coarse coal water slurry 13, 23, 33, 43, 53 and the stream of fine coal water slurry 15, 25, 35, 45, 55 may be analyzed, for example, by a laser PSD analyzer for facilitation of determination of the amounts of the concentrated stream 17, 27, 37, 47, 57 and remaining portions of the stream of coarse coal water slurry 13, 23, 33, 43, 53 and the stream of fine coal water slurry 15, 25, 35, 45, 55.

In some embodiments, during mixing, a mixer (not shown) may be employed to mix the concentrated stream 17, 27, 37, 47, 57 and remaining portions of the stream of coarse coal water slurry 13, 23, 33, 43, 53 and the stream of fine coal water slurry 15, 25, 35, 45, 55 within the mixing unit 18, 28, 38, 48, 58, and feed rates of the concentrated stream 17, 27, 37, 47, 57 and remaining portions of the stream of coarse coal water slurry 13, 23, 33, 43, 53 and the stream of fine coal water slurry 15, 25, 35, 45, 55 may be controlled for introduction into the mixing unit 18, 28, 38, 48, 58 so as to ensure the relatively smaller coal particles to be dispersed between the relatively larger coal particles.

In some embodiments, the mixing unit 18, 28, 38, 48, 58 comprises a slurry tank (not shown) to store the coal water slurry 11, 21, 31, 41, 51 after mixing.

As used herein, the term "coal water slurry" may indicate a mixture of certain amounts of coal, water and optionally additives for producing energy used in generating electricity, heating, support processing, and manufacturing.

Typically, the coal water slurry 11, 21, 31, 41, 51 may comprise from about 55 wt % to about 70 wt % of coal particles, from about 30 wt % to about 45 wt % of water, and optionally a certain amount, for example less than about 1 wt % of additives. It should be noted that embodiments of the invention do not limit to any particular types and amounts of coal or additives for the coal water slurry. Non-limiting examples of the additives 122, 142, 222, 242, 322, 342, 422, 442, 522, 542 include alkylnaphthelene sulfonate and polyoxyalkylene alkyl ether.

In some embodiments, the coal water slurry 11, 21, 31, 41, 51 has the following particle size distribution (PSD): first coal particles in a range of from about 20 wt % to about 50 wt % of the coal in the coal water slurry 11, 21, 31, 41, 51 and having particle sizes smaller than 44 μm, second coal particles in a range of from about 20 wt % to about 70 wt % of the coal in the coal water slurry 11, 21, 31, 41, 51 and having particle sizes in a range of from about 44 μm to about 420 μm, and third coal particles in a range of from 10 wt % to about 40 wt % of the coal in the coal water slurry 11, 21, 31, 41, 51 and having particle sizes in a range of from about 420 μm to about 1000 μm.

In some embodiments, the first coal particles may be in range of from about 25 wt % to about 45 wt % of the weight of the coal in the coal water slurry 11, 21, 31, 41, 51. The second coal particles may be in a range of from about 30 wt % to about 60 wt % of the weight of the coal in the coal water slurry 11, 21, 31, 41, 51. The third coal particles may be in a range of from about 20 wt % to about 30 wt % of the weight of the coal in the coal water slurry 11, 21, 31, 41, 51. In certain applications, the first coal particles may be in a range of from about 30 wt % to about 40 wt % of the weight of the coal in the coal water slurry 11, 21, 31, 41, 51. The second coal particles may have the particle sizes in a range of from about 75 μm to about 250 μm. The third coal particles may have the particle sizes in a range of from about 600 μm to about 850 μm. Additionally, the second coal particles may have the particle sizes in a range of from about 150 μm to about 250 μm.

In some embodiments, the system 10, 20, 30, 40, 50 optionally comprises a pumping unit 100, 200, 300, 400, 500 after the mixing unit 18, 28, 38, 48, 58 to pump the coal water slurry 11, 21, 31, 41, 51 to a consumption unit 101, 201, 301, 401, 501, e.g., a gasifier.

After mixing, the coal particles having the relatively smaller particle sizes may be dispersed between the coal particles having the relatively larger particle sizes so as to increase the coal concentration of the coal water slurry 11, 21, 31, 41, 51 to be prepared. In addition, the concentration unit 16, 26, 36, 46, 56 removes the extra water from a portion (greater than 0% to equal to 100%) of the stream of coarse coal water slurry 13, 23, 33, 43, 53 and the stream of fine coal water slurry 15, 25, 35, 45, 55, which further improves the coal concentration of the coal water slurry 11, 21, 31, 41, 51. On the other hand, both the coarse coal water slurry 13, 23, 33, 43, 53 and the fine coal water slurry 15, 25, 35, 45, 55 are prepared by wet grinding, thereby reducing the cost for explosion proof during grinding and handling fine dry coal particles and eliminating the problem of the fine particles agglomeration taking place while mixing with water.

Furthermore, low rank coal may be used to produce the coal water slurry which is cost effective. In certain applications, other suitable carbonaceous materials may also be used for preparing the coal water slurries.

EXAMPLE

The following example is included to provide an additional guidance to those of ordinary skill in the art in practicing the claimed invention. This example does not limit the invention as defined in the appended claims.

Properties of one coal having a Hardgrove index (HGI) of 106 are shown in Table 1 and Table 2 below. The highest concentration of this coal in a coal water slurry (CWS) made using a traditional wet rod mill is 54.63 wt % which is achieved at a viscosity of 565.33 cP and has a particle size distribution (PSD) shown in Table 3.

TABLE 1

| Ultimate Analysis (wt %, Dry Basis) | | | | | |
|---|---|---|---|---|---|
| Carbon | Hydrogen | Nitrogen | Sulfur | Ash | Oxygen |
| 74.37 | 4.15 | 0.70 | 0.82 | 4.92 | 15.04 |

TABLE 2

| Proximate Analysis (wt %, Dry Basis) | | |
|---|---|---|
| Volatile | Fixed Carbon | Ash |
| 30.39 | 64.69 | 4.92 |

TABLE 3

| Particle sizes (μm) | Weight percentage (wt %) |
|---|---|
| 420-1000 | 10.9 |
| 250-420 | 19.6 |
| 150-250 | 14.0 |
| 75-150 | 13.3 |
| 44-75 | 7.9 |
| <44 | 34.3 |

Two streams of raw grinding products of the coal were prepared: the first stream was the coarse coal water slurry (CWS) ground by a rod mill while a coal water slurry additive FP (Q/GHBC202-2003) from Shanghai Coking and Chemical Co., Shanghai, China was introduced with a ratio of dried additive and dried coal being 0.7%; and the second stream was the fine CWS while a coal water slurry additive FP (Q/GHBC202-2003) from Shanghai Coking and Chemical Co., Shanghai, China was introduced with a ratio of dried additive and dried coal being 1%.

The first stream had a mean particle size (d50) of 150 μm and a PSD shown in Table 4 below. The coal concentration in the first stream was 54.79% and the highest achievable coal concentration was 56.73% @ 441.9 cP with an acceptable flowability of the coal water slurry. The second stream had a d50 of 22.5 μm and a PSD shown in table 5 below. The coal concentration in the second stream was 54.46% and the highest achievable coal concentration was 55.39% @ 1583 cP with an acceptable flowability of the coal water slurry. Obviously, it is impossible to get a CWS with a coal concentration higher than 56.73% by simply mixing these two CWS streams.

TABLE 4

| PSD of the coarse CWS from the rod mill | |
|---|---|
| Particle sizes (μm) | Weight percentage (wt %) |
| 420-1000 | 19.0 |
| 250-420 | 18.7 |
| 150-250 | 12.2 |
| 75-150 | 12.3 |
| 44-75 | 7.1 |
| <44 | 30.7 |

TABLE 5

| PSD of the fine CWS | |
|---|---|
| Particle sizes (μm) | Weight percentage (wt %) |
| 150-250 | 0.36 |
| 75-250 | 4.92 |
| 44-75 | 14.37 |
| <44 | 80.35 |

The first stream was concentrated with vacuum filtration at a negative pressure in a range of from about 0.01 MPa to about 0.1 MPa, after which the coal concentration was 70.89% compared with the original concentration 54.79% as shown in table 6 below. The second stream of CWS (7.69 g) and 21.24 g of the filtrate cake of the stream of coarse CWS were mixed together and extra water (3.20 g) was added. The final achievable coal concentration of the CWS measured with a moisture analyzer (Sartorius MA 30) to be 59.91% at 1028.13 cP measured by a viscometer (Anton Paar MCR 300) with an acceptable flowability.

TABLE 6

| Sample | coal concentration before filtration, % (dry basis weight) | coal concentration after filtration, % (dry basis weight) | Highest coal concentration with an acceptable flowability, wt % |
|---|---|---|---|
| Fine CWS | 54.46 | N/A | 55.39 @ 1583 cP |
| Coarse CWS | 54.79 | 70.89 | 56.73 @ 441.9 cP |
| Fine CWS + filtrated coarse CWS | N/A | N/A | 59.91 @ 1028.13 cP |

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the spirit and scope of the disclosure as defined by the following claims.

What is claimed is:

1. A method for preparing a coal water slurry, comprising:
preparing a stream of coarse coal water slurry;
preparing a stream of fine coal water slurry;
concentrating a portion of at least one of the stream of coarse coal water slurry and the stream of fine coal water slurry, to provide a concentrated stream having a higher coal concentration than the portion of at least one of the stream of coarse coal water slurry and the stream of fine coal water slurry; and
mixing the concentrated stream and the remaining portions of the stream of coarse coal water slurry and the stream of fine coal water slurry.

2. The method of claim 1, wherein the concentrating step comprises passing the portion of at least one of the stream of coarse coal water slurry and the stream of fine coal water slurry through at least one of a filter, a centrifuge and an evaporator.

3. The method of claim 1, wherein the concentrating step comprises passing the portion of at least one of the stream of coarse coal water slurry and the stream of fine coal water slurry through a vacuum filter.

4. The method of claim 3, additionally comprising recycling a filtrate from the vacuum filter back to at least one of a first unit and a second unit.

5. The method of claim 1, wherein the portion of at least one of the stream of coarse coal water slurry and the stream of fine coal water slurry is at least a portion of the stream of the coarse coal water slurry.

6. The method of claim 1, wherein the portion of at least one of the stream of coarse coal water slurry and the stream of fine coal water slurry is at least a portion of the stream of the fine coal water slurry.

7. The method of claim 1, wherein the portion of at least one of the stream of coarse coal water slurry and the stream of fine coal water slurry is a mixture of at least a portion of the stream of the coarse coal water slurry and the stream of fine coal water slurry.

8. The method of claim 1, additionally comprising screening the portion of at least one of the stream of coarse coal water slurry and the stream of fine coal water slurry before the concentrating step.

9. The method of claim 1, wherein the stream of coarse coal water slurry comprises coal particles having a maximum particle size of less than or equal to about 1500 μm and a mean particle size of greater than or equal to about 100 μm.

10. The method of claim 1, wherein coal from the stream of coarse coal water slurry is greater than or equal to about 70 wt % of coal of the coal water slurry.

11. The method of claim 1, wherein the stream of fine coal water slurry comprises coal particles having a mean particle size of smaller than or equal to about 25 μm.

12. The method of claim 1, wherein coal from the stream of fine coal water slurry is less than or equal to about 30 wt % of coal of the coal water slurry.

13. A method for preparing a coal water slurry from a low rank coal, the method comprising:
preparing a stream of coarse coal water slurry from a low rank coal selected from at least one of sub-bituminous coal and lignite;
preparing a stream of fine coal water slurry from a low rank coal selected from at least one of sub-bituminous coal and lignite;
concentrating a portion of the stream of coarse coal water slurry, to provide a concentrated stream having a higher coal concentration than the portion of the stream of coarse coal water slurry; and
mixing the concentrated stream and the remaining portions of the stream of coarse coal water slurry and the stream of fine coal water slurry.

14. The method of claim 1, wherein the stream of coarse coal water slurry is prepared in a wet mill.

15. The method of claim 1, wherein the stream of fine coal water slurry is prepared in a wet fine mill.

16. The method of claim 14, wherein the wet mill is a wet rod mill.

17. The method of claim 14, wherein the wet fine mill is selected from the group consisting of vibrating mill, a roller grinding mill, a Loesche mill and combinations thereof.

18. The method of claim 1, wherein the coal water slurry has a coal particle size distribution of from about 20 wt % to about 50 wt % of particles having a particle size of less than 44 μm, from about 20 wt % to about 70 wt % of particles having a particle size in a range of from about 44 μm to about 420 μm and from about 10 wt % to about 40 wt % of particles having a particle size in a range of from about 420 μm to about 1000 μm.

19. The method of claim 13, wherein the stream of coarse coal water slurry is prepared in a wet mill.

20. The method of claim 13, wherein the stream of fine coal water slurry is prepared in a wet fine mill.

21. The method of claim 13, wherein the coal water slurry has a coal particle size distribution of from about 20 wt % to about 50 wt % of particles having a particle size of less than 44 μm, from about 20 wt % to about 70 wt % of particles having a particle size in a range of from about 44 μm to about 420 μm and from about 10 wt % to about 40 wt % of particles having a particle size in a range of from about 420 μm to about 1000 μm.

* * * * *